US008499370B1

(12) United States Patent
Felicetta

(10) Patent No.: US 8,499,370 B1
(45) Date of Patent: Aug. 6, 2013

(54) COLLAPSIBLE PORTABLE TOILET ASSEMBLY

(76) Inventor: Maria A. Felicetta, Huntington, NY (US)

( * ) Notice: Subject to any disclaimer, the term of this patent is extended or adjusted under 35 U.S.C. 154(b) by 0 days.

(21) Appl. No.: 13/495,371

(22) Filed: Jun. 13, 2012

(51) Int. Cl.
*A47K 11/04* (2006.01)

(52) U.S. Cl.
USPC ..... 4/476; 4/479

(58) Field of Classification Search
USPC ..... 4/449, 465, 476, 479, 902
See application file for complete search history.

(56) References Cited

U.S. PATENT DOCUMENTS

| | | | | |
|---|---|---|---|---|
| 3,070,810 | A | 1/1963 | Jones | |
| 3,600,719 | A * | 8/1971 | Karr | 4/476 |
| D378,124 | S | 2/1997 | Jordan | |
| 5,920,927 | A * | 7/1999 | Thomas | 4/449 |
| 5,974,597 | A * | 11/1999 | Conwell | 4/476 |
| 6,341,386 | B1 * | 1/2002 | Phillips et al. | 4/479 |
| 6,625,823 | B1 | 9/2003 | Abbott | |
| 2007/0000042 | A1 | 1/2007 | Wee | |
| 2009/0044325 | A1 | 2/2009 | Sell | |
| 2010/0050333 | A1 | 3/2010 | Jenkins et al. | |

* cited by examiner

*Primary Examiner* — Tuan N Nguyen

(57) ABSTRACT

A collapsible portable toilet assembly includes a housing that has a top wall, a bottom wall and a perimeter wall hingedly coupled to and extending between a perimeter edge of the top and bottom walls so the perimeter wall is collapsible. The top wall has a toilet aperture extending therethrough to access an interior of the housing. The housing is positionable in a collapsed position and extended position. A seat is coupled to the top wall. The seat is positioned around the toilet aperture. A base removably receives the housing so the bottom wall of the housing abuts an upper surface of the base. A plurality of legs is hingedly coupled to and extends downwardly from the base. The legs are configured to abut a support surface supporting the base above the support surface. A screen is selectively positionable around the toilet assembly so the user is concealed.

18 Claims, 6 Drawing Sheets

COLLAPSIBLE PORTABLE TOILET ASSEMBLY

BACKGROUND OF THE DISCLOSURE

Field of the Disclosure

The disclosure relates to collapsible portable toilet devices and more particularly pertains to a new collapsible portable toilet device for providing a toilet facility.

SUMMARY OF THE DISCLOSURE

An embodiment of the disclosure meets the needs presented above by generally comprising a housing that has a top wall, a bottom wall and a perimeter wall hingedly coupled to and extending between a perimeter edge of the top and bottom walls so the perimeter wall is collapsible. The top wall has a toilet aperture extending therethrough to access an interior of the housing. The housing is positionable in a collapsed position so the top and bottom walls abut. The housing is positionable in an extended position so the top and bottom walls are spaced from each other. A seat is coupled to the top wall. The seat comprises a closed loop. The seat is positioned around the toilet aperture. The seat is configured to support a user. A base removably receives the housing so the bottom wall of the housing abuts an upper surface of the base. A plurality of legs is hingedly coupled to and extends downwardly from the base. The legs are configured to abut a support surface supporting the base above the support surface. A screen is selectively positionable around the toilet assembly when a user utilizes the toilet assembly so the user is concealed from observers.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
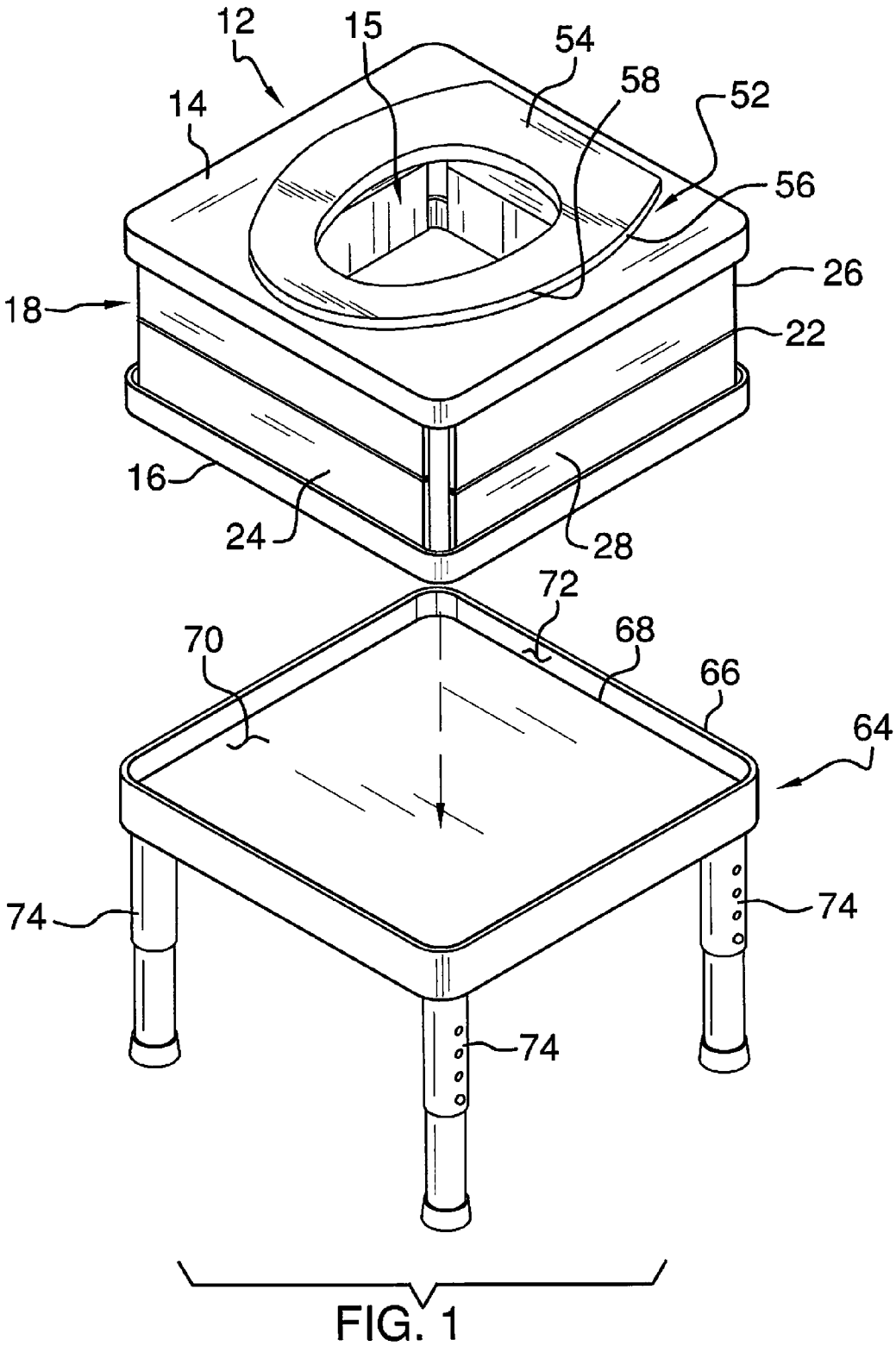
FIG. 1 is a perspective view of a collapsible portable toilet assembly according to an embodiment of the disclosure.
Figure 2:
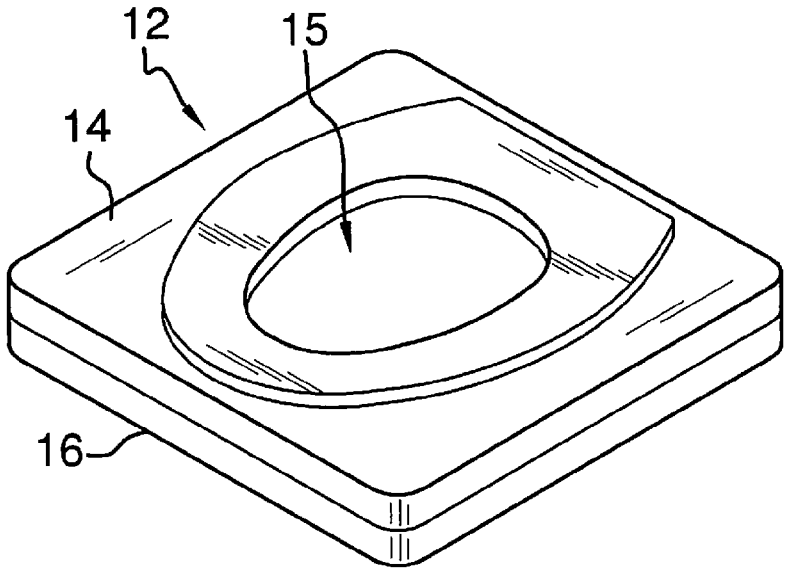
FIG. 2 is a top perspective view of an embodiment of the disclosure.
Figure 3:
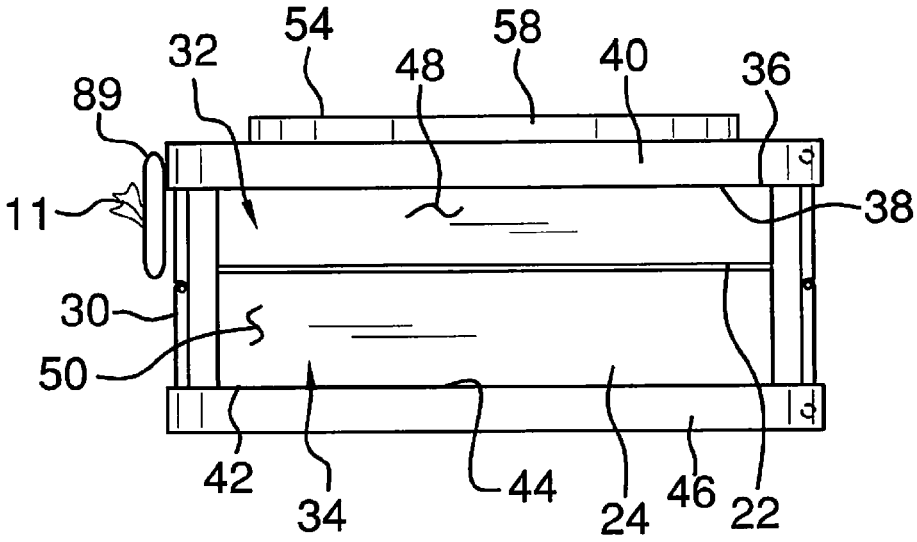
FIG. 3 is a front view of an embodiment of the disclosure.
Figure 4:
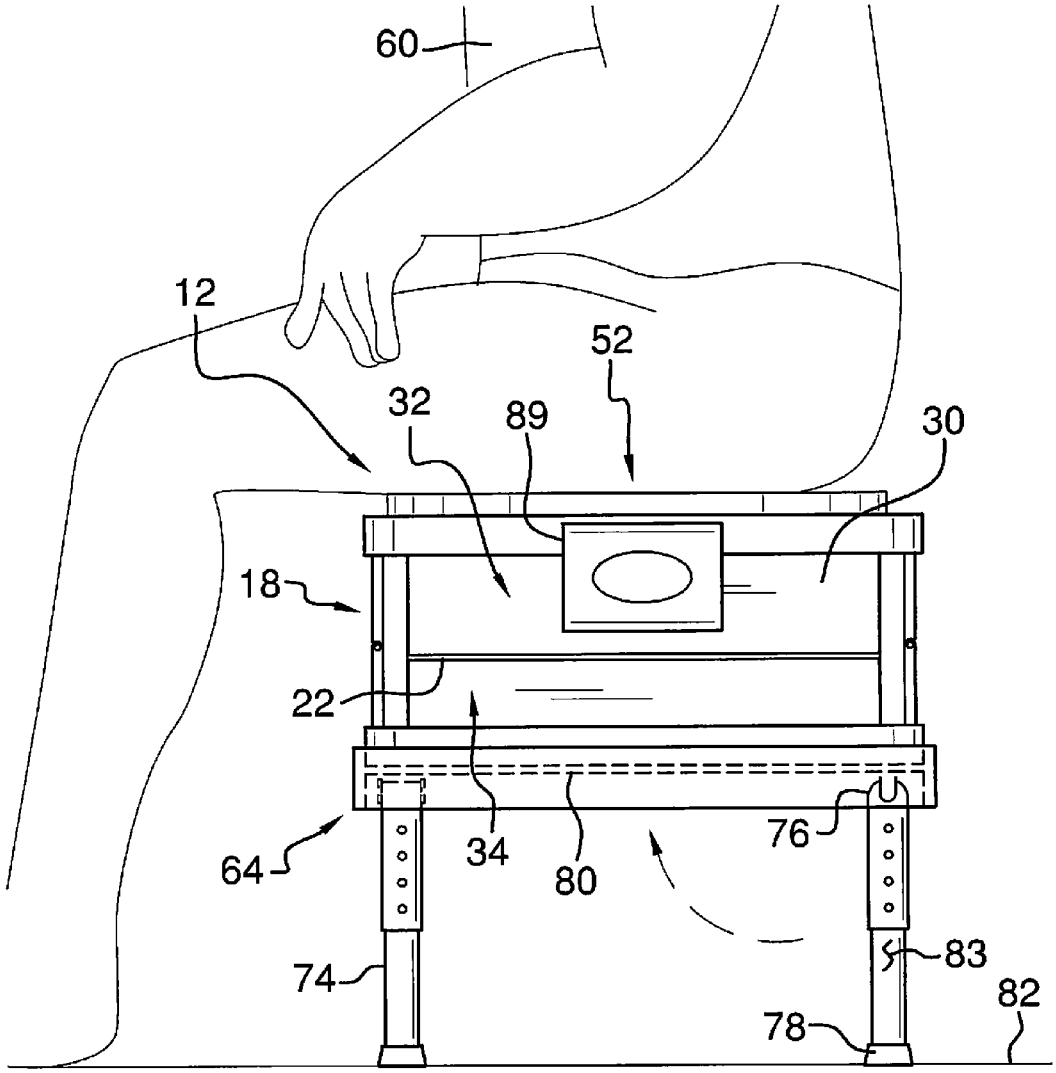
FIG. 4 is a right side view of an embodiment of the disclosure.
Figure 5:
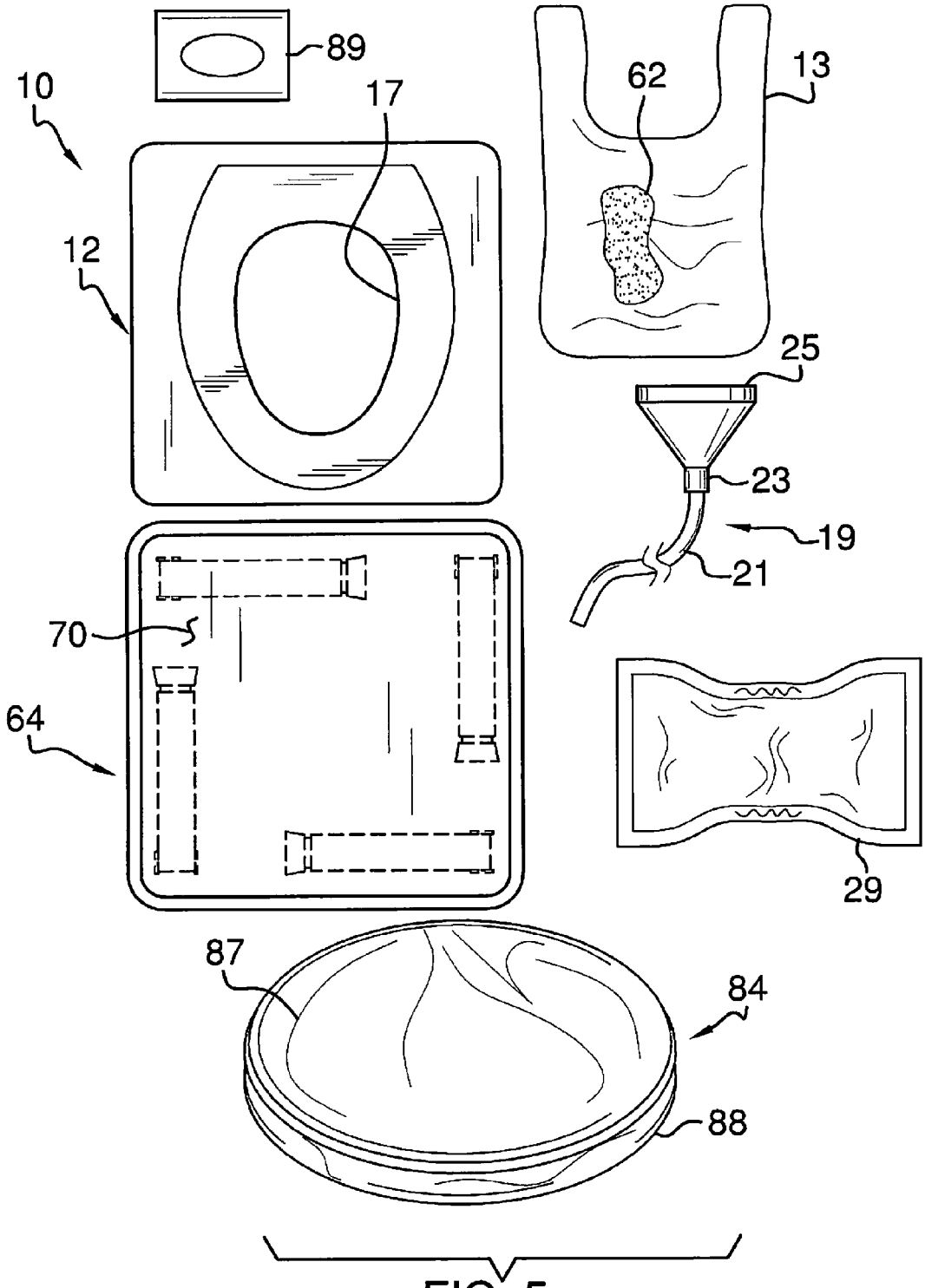
FIG. 5 is a top view of an embodiment of the disclosure.
Figure 6:
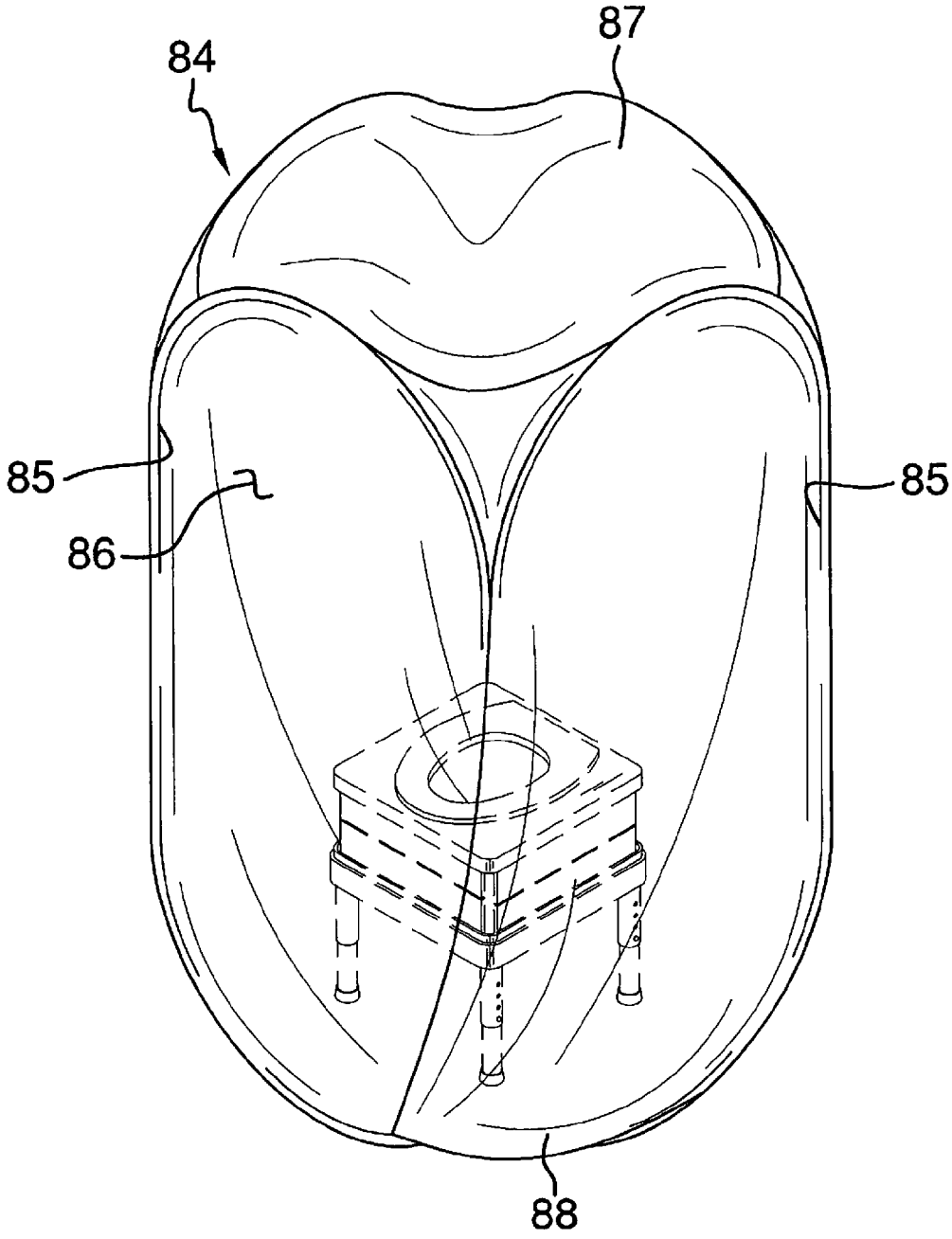
FIG. 6 is a right side perspective view of an embodiment of the disclosure.
Figure 7:
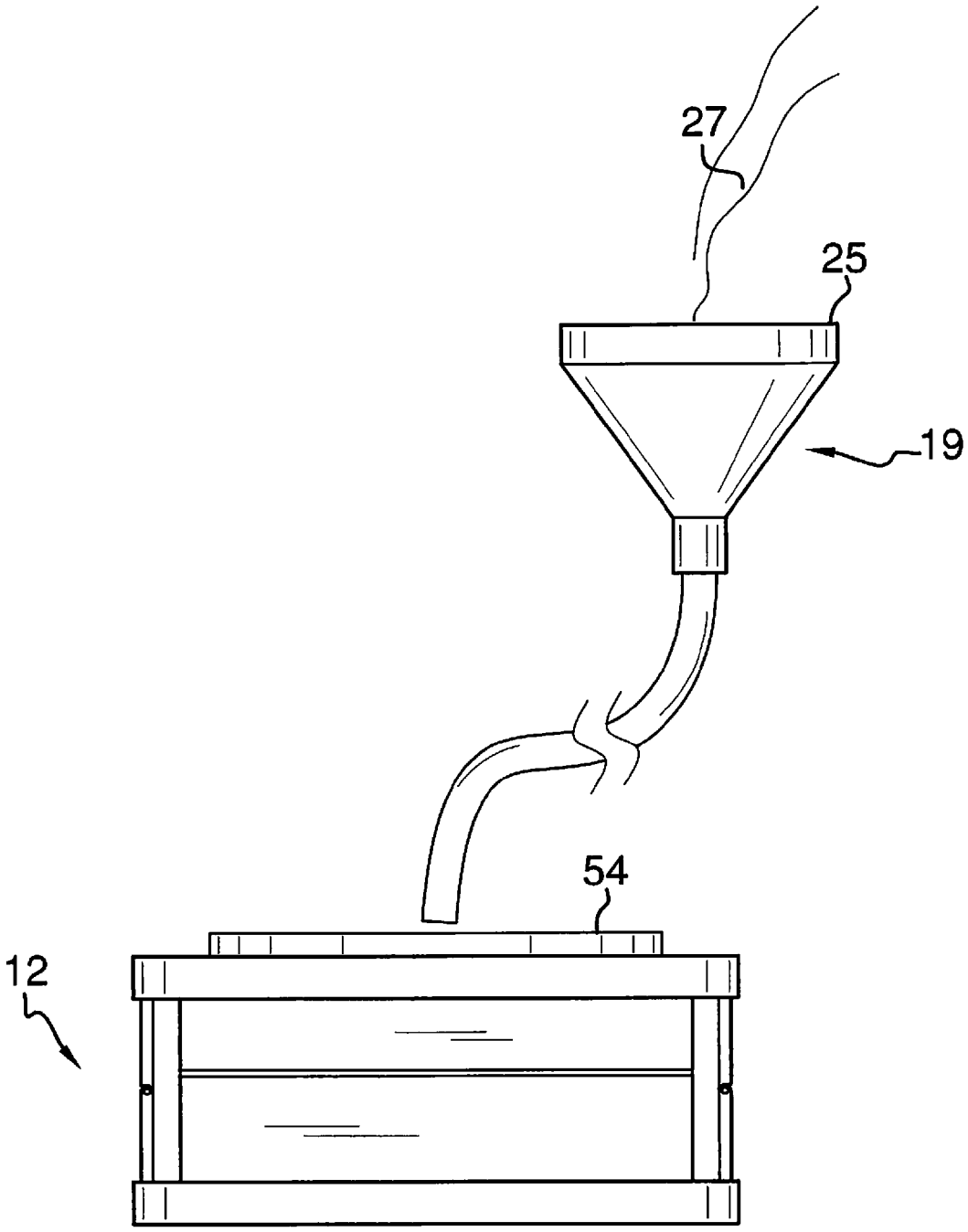
FIG. 7 is an in-use view of an embodiment of the disclosure.

With reference now to the drawings, and in particular to FIGS. 1 through 7 thereof, a new collapsible portable toilet device embodying the principles and concepts of an embodiment of the disclosure and generally designated by the reference numeral 10 will be described.

As best illustrated in FIGS. 1 through 7, the collapsible portable toilet assembly 10 generally comprises a housing 12 that has a top wall 14, a bottom wall 16 and a perimeter wall 18 hingedly coupled to and extending between a perimeter edge 20 of the top 14 and bottom 16 walls. The top wall 14 has a toilet aperture 15 extending therethrough to access an interior of the housing 12. The perimeter wall 18 includes a bendable section 22 extending laterally around each of a front 24, back 26, first lateral 28 and second lateral 30 wall of the perimeter wall 18 so the bendable section 22 defines an upper portion 32 and a lower portion 34 of the perimeter wall 18. An upper edge 36 of the upper portion 32 of the perimeter wall 18 is movably coupled to a bottom edge 38 of the top wall 14 so the upper edge 36 of the upper portion 32 is coextensive with an outside edge 40 of the top wall 14. A lower edge 42 of the lower portion 34 is movably coupled to an uppermost edge 44 of the bottom wall 16 so the lower edge 42 of the lower portion 34 is coextensive with an outer edge 46 of the bottom wall 16.

The housing 12 is positionable in a collapsed position having the perimeter wall 18 inwardly bent at the bendable section 22. In the collapsed position an outer surface 48 of the upper portion 32 abuts an exterior surface 50 of the lower portion 34 so the bottom edge 38 of the top wall 14 abuts the uppermost edge 44 of the bottom wall 16. The housing 12 is positionable in an extended position so the outer surface 48 of the upper portion 32 of the perimeter wall 18 is coplanar with the exterior surface 50 of the lower portion 34 of the perimeter wall 18 so the top 14 and bottom 16 walls are spaced apart from each other. The housing 12 may be comprised of a rigid and fluid impermeable material.

A seat 52 has a top side 54, a bottom side 56 and a peripheral edge 58. The seat 52 comprises a closed loop. The seat 52 is positioned around the toilet aperture 15. The bottom side 56 is coupled to the top wall 14 of the housing 12 so the top side 54 may support a user 60. The seat 52 supports the user 60 so the user's waste 62 selectively enters the interior of the housing 12 through the toilet aperture 15. The seat 52 may comprise a toilet seat of any conventional design.

A base 64 includes a peripheral wall 66 coupled to and extending upwardly from an extraneous edge 68 of the base 64. The housing 12 is removably positioned on the base 64 so the bottom wall 16 of the housing 12 abuts an upper surface 70 of the base 64. After the housing 12 is placed on the base 64 the outer edge 46 of the bottom wall 16 is positioned proximal an inner surface 72 of the peripheral wall 66. The housing 12 may be positioned on the base 64 if the assembly 10 is to be used outdoors.

A plurality of legs 74 has a top end 76 and a bottom end 78. The top end 76 is hingedly coupled to a bottom surface 80 of the base 64 so each of the legs 74 is positioned proximal an associated one of four corners 81 of the base 74. The legs 74 are positionable in an extended position that has the bottom end 78 directed downwardly from the bottom surface 80 of the base 64 so the bottom end 78 may abut a support surface 82 supporting the base 64 above the support surface 82. The legs 74 are positionable in a retracted position so an outside surface 83 of the legs 74 abuts the bottom surface 80 of the base 64. The plurality of legs 74 is selectively telescopic so the legs 74 are retained at one of a plurality of selectable heights.

A screen 84 has a plurality of biasing members 85 coupled to an innermost surface 86 of the screen 84. The biasing members may comprise a resiliently bendable material. The biasing members 85 bias an overhead end 87 of the screen 84 upwardly from a basal end 88 of the screen 84. The basal end 88 of the screen 84 is open and the overhead end 87 of the screen 84 is closed. The screen 84 is positionable in a deployed position such that the screen 84 is placed around the toilet assembly 10 and the overhead end 87 is biased upwardly from the basal end 88 so the screen 84 conceals the toilet assembly 10 to provide privacy. In the deployed position the screen 84 may have a height between 1.5 m and 1.8 m. The screen 84 may be collapsed for storage so the basal end 88 and the overhead end 87 abut. The screen 84 may be comprised of a deformable material.

A dispenser 89 is coupled to the outside edge 40 of the top wall 14 of the housing 12. The dispenser 89 containes a plurality of disposable wipes 11 so the wipes 11 are selectively dispensed from the dispenser 89. The dispenser 89 and disposable wipes 11 may be of any conventional design. A bag 13 is removably coupled to an inner edge 17 of the toilet aperture 15. The bag 13 is positioned within the interior of the housing 12 so the bag 13 retains the user's waste 62. The bag 13 may be disposed of after the user's waste 62 is deposited in the bag 13.

A funnel 19 has a hose 21 coupled to and extending away from a narrow end 23 of the funnel 19. A wide end 25 of the funnel 19 receives urine 27 from the user 60 so the hose 21 directs the urine 27 into the bag 13. A disposable diaper 29 is positionable within the bag 13. The disposable diaper 29 facilitates disposal of the user's waste 62. The disposable diaper 29 may be of any conventional design.

In use, the toilet assembly 10 may be used indoors or outdoors. The housing 12 may be placed on the base 64 when the toilet assembly 10 is used outdoors or the housing 12 may be placed on the support surface 82. The screen 84 may be deployed to provide privacy while using the toilet assembly 10. The diaper 29 may be worn by the user 60 before or after using the toilet assembly 10.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A collapsible portable toilet assembly comprising:

a housing having a top wall, a bottom wall and a perimeter wall hingedly coupled to and extending between a perimeter edge of said top and bottom walls whereby said perimeter wall is collapsible, said top wall having a toilet aperture extending therethrough to access an interior of said housing, said housing being positionable in a collapsed position having said top and bottom walls abut, said housing being positionable in an extended position having said top and bottom walls spaced from each other;

a seat coupled to said top wall, said seat comprising a closed loop, said seat being positioned around said toilet aperture, said seat being configured to support a user;

a base removably receiving said housing whereby said bottom wall of said housing abuts an upper surface of said base;

a plurality of legs hingedly coupled to and extending downwardly from said base, said legs being configured to abut a support surface supporting said base above the support surface; and a screen being selectively positionable around said toilet assembly when a user utilizes said toilet assembly whereby the user is concealed from observers.

2. The assembly according to claim 1, further including said perimeter wall including a bendable section extending laterally around each of a front, back, first lateral and second lateral wall of said perimeter wall whereby said bendable section defines an upper portion and a lower portion of said perimeter wall.

3. The assembly according to claim 2, further including an upper edge of said upper portion of said perimeter wall being movably coupled to a bottom edge of said top wall whereby said upper edge of said upper portion is coextensive with an outside edge of said top wall.

4. The assembly according to claim 3, further including a lower edge of said lower portion being movably coupled to an uppermost edge of said bottom wall whereby said lower edge of said lower portion is coextensive with an outer edge of said bottom wall.

5. The assembly according to claim 4, further including said housing being positionable in a collapsed position having said perimeter wall being inwardly bent at said bendable section such that an outer surface of said upper portion abuts an exterior surface of said lower portion whereby said bottom edge of said top wall abuts said uppermost edge of said bottom wall.

6. The assembly according to claim 5, further including said housing being positionable in an extended position having said outer surface of said upper portion of said perimeter wall being coplanar with said exterior surface of said lower portion of said perimeter wall whereby said top and bottom walls are spaced apart from each other.

7. The assembly according to claim 1, further including said seat having a top side, a bottom side and a peripheral edge, said bottom side being coupled to said top wall of said housing whereby said top side is configured to support a user, further including said seat supporting the user whereby the user's waste selectively enters said interior of said housing through said toilet aperture.

8. The assembly according to claim 1, further including said base including a peripheral wall coupled to and extending upwardly from an extraneous edge of said base, said housing being removably positioned on said base whereby said bottom wall of said housing abuts an upper surface of said base such that an outer edge of said bottom wall is positioned proximal an inner surface of said peripheral wall.

9. The assembly according to claim 1, further including said plurality of legs having a top end and a bottom end, said top end being hingedly coupled to a bottom surface of said base whereby each of said legs is positioned proximal an associated one of four corners of said base.

10. The assembly according to claim 9, further including said legs being positionable in an extended position having said bottom end directed downwardly from said bottom surface of said base whereby said bottom end is configured to abut a support surface, said legs being positionable in a retracted position whereby an outside surface of said legs abuts said bottom surface of said base.

11. The assembly according to claim 10, further including said plurality of legs being selectively telescopic whereby said legs are retained at one of a plurality of selectable heights.

12. The assembly according to claim 1, further including said screen having a plurality of biasing members coupled to an innermost surface of said screen, said biasing members biasing an overhead end of said screen upwardly from a basal end of said screen.

13. The assembly according to claim 1, further including said screen being positionable in a deployed position such that said screen is placed around said toilet assembly and said overhead end is biased upwardly from said basal end whereby said screen conceals the toilet assembly to provide privacy.

14. The assembly according to claim 1, further including a dispenser coupled to an outside edge of said top wall of said housing, said dispenser containing a plurality of disposable wipes whereby the wipes are selectively dispensed from said dispenser.

15. The assembly according to claim 1, further including a bag being removably coupled to an inner edge of said toilet aperture, said bag being positioned within said interior of said housing whereby said bag retains the user's waste.

16. The assembly according to claim 15, further including a funnel, said funnel having a hose coupled to and extending away from a narrow end of said funnel, a wide end of said funnel receiving urine from the user whereby said hose directs the urine into said bag.

17. The assembly according to claim 15, further including a disposable diaper being positionable within said bag, said disposable diaper facilitating disposal of a user's waste.

18. A collapsible portable toilet assembly comprising:

a housing having a top wall, a bottom wall and a perimeter wall hingedly coupled to and extending between a perimeter edge of said top and bottom walls, said top wall having a toilet aperture extending therethrough to access an interior of said housing, said perimeter wall including a bendable section extending laterally around each of a front, back, first lateral and second lateral wall of said perimeter wall whereby said bendable section defines an upper portion and a lower portion of said perimeter wall, an upper edge of said upper portion of said perimeter wall being movably coupled to a bottom edge of said top wall whereby said upper edge of said upper portion is coextensive with an outside edge of said top wall, a lower edge of said lower portion being movably coupled to an uppermost edge of said bottom wall whereby said lower edge of said lower portion is coextensive with an outer edge of said bottom wall, said housing being positionable in a collapsed position having said perimeter wall being inwardly bent at said bendable section such that an outer surface of said upper portion abuts an exterior surface of said lower portion whereby said bottom edge of said top wall abuts said uppermost edge of said bottom wall, said housing being positionable in an extended position having said outer surface of said upper portion of said perimeter wall being coplanar with said exterior surface of said lower portion of said perimeter wall whereby said top and bottom walls are spaced apart from each other;

a seat having a top side, a bottom side and a peripheral edge, said seat comprising a closed loop, said seat being positioned around said toilet aperture, said bottom side being coupled to said top wall of said housing whereby said top side is configured to support a user, said seat supporting the user whereby the user's waste selectively enters said interior of said housing through said toilet aperture;

a base including a peripheral wall coupled to and extending upwardly from an extraneous edge of said base, said housing being removably positioned on said base whereby said bottom wall of said housing abuts an upper surface of said base such that an outer edge of said bottom wall is positioned proximal an inner surface of said peripheral wall;

a plurality of legs having a top end and a bottom end, said top end being hingedly coupled to a bottom surface of said base whereby each of said legs is positioned proximal an associated one of four corners of said base, said legs being positionable in an extended position having said bottom end directed downwardly from said bottom surface of said base whereby said bottom end is configured to abut a support surface supporting said base above the support surface, said legs being positionable in a retracted position whereby an outside surface of said legs abuts said bottom surface of said base, said plurality of legs being selectively telescopic whereby said legs are retained at one of a plurality of selectable heights;

a screen having a plurality of biasing members coupled to an innermost surface of said screen, said biasing members biasing an overhead end of said screen upwardly from a basal end of said screen, said screen being positionable in a deployed position such that said screen is placed around said toilet assembly and said overhead end is biased upwardly from said basal end whereby said screen conceals the toilet assembly to provide privacy;

a dispenser coupled to an outside edge of said top wall of said housing, said dispenser containing a plurality of disposable wipes whereby the wipes are selectively dispensed from said dispenser;

a bag being removably coupled to an inner edge of said toilet aperture, said bag being positioned within said interior of said housing whereby said bag retains the user's waste;

a funnel, said funnel having a hose coupled to and extending away from a narrow end of said funnel, a wide end of said funnel receiving urine from the user whereby said hose directs the urine into said bag; and a disposable diaper being positionable within said bag, said disposable diaper facilitating disposal of the user's waste.

* * * * *